US006408592B1

(12) United States Patent
Hourani

(10) Patent No.: US 6,408,592 B1
(45) Date of Patent: Jun. 25, 2002

(54) METHODS AND APPARATUSES FOR PROTECTING WINDOWS AND BUILDINGS DURING A WIND STORM

(76) Inventor: Monzer A. Hourani, #3 Carlton Park, Houston, TX (US) 77024

( * ) Notice: Subject to any disclaimer, the term of this patent is extended or adjusted under 35 U.S.C. 154(b) by 0 days.

(21) Appl. No.: 09/665,155

(22) Filed: Sep. 18, 2000

(51) Int. Cl.[7] ..... E04B 1/00

(52) U.S. Cl. ..... 52/741.3; 52/204.5; 52/127.2; 52/202; 52/456; 52/203; 52/DIG. 12; 49/61; 254/98

(58) Field of Search ..... 52/741.3, 204.5, 52/127.2, 202, 456, 203, DIG. 12; 49/61; 254/98

(56) References Cited

U.S. PATENT DOCUMENTS

| | | | | | |
|---|---|---|---|---|---|
| 810,604 | A | | 1/1906 | Baier | |
| 1,731,114 | A | | 10/1929 | Sparrow | |
| 2,025,161 | A | | 12/1935 | Franklin | |
| 2,183,135 | A | | 12/1939 | Dorf | |
| 2,417,233 | A | | 3/1947 | Buford | |
| 2,523,044 | A | * | 9/1950 | Michela | 20/40 |
| 2,549,661 | A | | 4/1951 | Carney | |
| 2,607,088 | A | | 8/1952 | Schoepfer | |
| 2,622,285 | A | | 12/1952 | Roos | |
| 2,777,174 | A | | 1/1957 | Carr | |
| 2,794,217 | A | | 6/1957 | Croft | |
| 3,968,607 | A | | 7/1976 | Baran | 52/173 R |
| 4,505,079 | A | | 3/1985 | Black | 52/202 |
| 4,598,520 | A | | 7/1986 | Ellstrom | 52/456 |
| 4,702,055 | A | * | 10/1987 | Ralph | 52/456 |
| 4,937,993 | A | * | 7/1990 | Hitchins | 52/455 |
| 4,989,384 | A | | 2/1991 | Kinghorn | 52/456 |
| 5,507,118 | A | | 4/1996 | Brown | 49/61 |
| 5,551,189 | A | | 9/1996 | Westfall | 49/76 |
| 5,673,883 | A | | 10/1997 | Figureroa, Jr. | 248/200.1 |
| 5,709,054 | A | | 1/1998 | McGillivray | 52/167.1 |
| 5,934,031 | A | | 8/1999 | deNormand | 52/204.5 |
| 6,021,610 | A | | 2/2000 | Hunt | 49/501 |
| 6,192,651 | B1 | * | 2/2000 | Donaldson | 52/742.13 |
| 6,082,062 | A | | 7/2000 | Alflen | 52/202 |

* cited by examiner

*Primary Examiner*—Carl D. Friedman
*Assistant Examiner*—Chi Q Nguyen
(74) *Attorney, Agent, or Firm*—Howrey Simon Arnold & White, LLP

(57) ABSTRACT

A brace for protecting windows and buildings during a high wind storm is disclosed. The brace includes a rigid member sized so as to fit within a window frame containing the window to be protected, and double-sided tape affixed to one side of the rigid member for affixing the rigid member to the window to be protected. Various method for imparting a force to the brace to cause it to become firmly wedged within the window frame of the window and building to be protected are also disclosed, and include the use of the installer's hands, the use of a hinged member rotatably connected to the brace which is capable of being wedged against the window frame, the use of a swing arm connected to the brace which can be firmly wedged against the window frame, and the use of a ratchet to advance a dampening member from within the brace to firmly engage the window frame. Methods of using the disclosed brace are also disclosed.

62 Claims, 5 Drawing Sheets

METHODS AND APPARATUSES FOR PROTECTING WINDOWS AND BUILDINGS DURING A WIND STORM

FIELD OF THE INVENTION

This invention relates generally to methods and apparatuses for protecting windows and buildings during a wind storm.

BACKGROUND OF THE INVENTION

As the oceans continue to warm due to global warming and depletion of the ozone layer, weather patterns are becoming increasingly unpredictable. These unpredictable weather patterns can result in severe storms and extremely high temperatures in some areas. The impact of these changes will likely increase the frequency and severity of hurricanes. Accordingly, it is expected that in the near future that the coastal territories surrounding the Gulf of Mexico and the East Coast of the United States, and other hurricane-prone coastal territories world-wide, will experience heavy losses due to hurricane damage. Some of these hurricanes are expected to be Category Five hurricanes with wind speed exceeding 150 miles per hour. Such a hurricane might be expected to deliver wind speeds of 135 miles per hour to cities such as Houston, Texas, the inventor's home city, which resides approximately 50 miles inland from the Gulf of Mexico.

Most steel-based buildings are designed to withstand some amount of wind forces by virtue of load-bearing structures incorporated in the core of the building, such as the use of "X" or "K" bracing around the elevators and stairs. Other buildings are designed around a rigid frame concept in which wind forces are transferred through the frame to the foundation of the building. In concrete-based buildings such approaches are commonly achieved using reinforced concrete or post-tension concrete technologies. Rarely do buildings contain bracing on the outside walls of the building because such bracing usually interferes with the aesthetics of the building. Despite these preventative measures, most buildings in Houston are not designed to withstand wind speeds of this magnitude; indeed, most commercial buildings are only designed to withstand average wind speeds of approximately around 110 miles per hour.

Thus, most, if not all, of the buildings on the United States coast line have never been designed or tested at wind speeds expected to be delivered by future high-intensity hurricanes. The result could be catastrophic damage; not only would the windows in these buildings be susceptible to breaking due to high positive and negative wind pressure thereupon, but the buildings themselves could be subject to irreparable damage as the swaying action of the building causes various sides of the building to be put under undue tension (elongation) and compression (shortening). In buildings built with a steel frame, some of the structural steel members of the building upon exposure to extreme wind velocity and pressure may go into the yield point of these members, causing major structural failure to the buildings and permanently hampering their integrity and feasibility. The same can be said for buildings built with a concrete frame. Moreover, even if these forces on the building are not sufficient to damage the building, the tensile and compressive forces, in conjunction with the positive or negative wind pressure, may be sufficient to "pop" or "crush" the windows in the building.

Of course, hurricane force winds are only temporary, and accordingly, it would be beneficial if some sort of temporary bracing could be applied to buildings during those critical time periods of hurricane force winds to help prevent windows and buildings from damage. Several prior art approaches have been devised to protect windows subject to high force winds. A common approach disclosed in the prior art involves mechanically affixing (e.g., by bolting) a brace to a window frame and then bringing a dampening member (e.g., a pad or suction cap) on the brace into contact with the window to be protected. See U.S. Pat. Nos. 5,709,054, 3,968,607, 2,607,088, 2,549,661, 2,025,161, 1,731,114, and 810,604. Sometimes this basic approach has employed apparatuses that contact but do not mechanically alter the window frame, for example, by bolting or drilling holes into them. See U.S. Pat. No. 2,794,217. Another approach involves affixing a brace directly to the window to be protected by suction cups without any mechanical connection of the brace to the window frame at all. See U.S. Pat. Nos. 2,523,044 and 2,417,233. Another common approach involves the use of various apparatuses to affix a protective sheet, such as a piece of plywood or a shutter, to the window. See 5,673,883, 5,507,118, 2,777,174 and 2,622,285. Still other creative approaches have been attempted. See U.S. Pat. Nos. 6,082,062, 6,021,610, 5,934,031, 5,551,189, 4,505,079 and 2,183,135. All of the U.S. Pat. Nos. mentioned in this paragraph are hereby incorporated by reference into the present disclosure for all that they teach.

These prior art window protection approaches have certain benefits, but they also suffer from shortcomings and complexities that are believed to impede their functionality and commercial marketability. For example, many of the prior art approaches require the frame surrounding the window to be altered, for example, by drilling holes, or affixing screws or brackets. This is generally frowned upon by the owner of the structure to be protected. Moreover, many of the prior art techniques involve the use of apparatuses that are very expensive to build or excessively difficult to install in a reasonable amount of time before a storm hits. Moreover, none of these prior art approaches is expected to provide significant increased stability to the structure of the building itself during high wind stresses.

SUMMARY OF THE INVENTION

One embodiment of the invention includes a brace for protecting windows and buildings during a high wind storm. The brace includes a rigid member sized so as to fit within a window frame containing the window to be protected, and double-sided tape (preferably 3M, Inc. Part No. 4658F) affixed to one side of the rigid member for affixing the rigid member to the window. The disclosed brace is cheap to manufacture and easy to install, but provides excellent rigidity to the protected window to prevent it from breaking when subject to high wind forces. Furthermore, installation of the braces does not require making any mechanical modification to the window frame, such as drilling holes into them. Additionally, imparting a stress to a given brace serves to wedge the brace inside the window frame and to impart a stress to the window, both of which further aids in achieving suitable window rigidity and building protection. Alternative embodiments for imparting this stress are disclosed and include the use of the installer's hands, the use of a hinged member rotatably connected to the brace which can be firmly wedged against the window frame, the use of a swing arm connected to the brace which can be firmly wedged against the window frame, and the use of a ratchet to advance a piston within the brace to firmly engage the window frame. When the disclosed braces are installed in the windows in a given building, the cumulative effect is to protect the building itself from wind storm damage, as well as the windows containing the braces.

BRIEF DESCRIPTION OF THE DRAWINGS

The foregoing and other features and aspects of the present invention will be best understood with reference to the following detailed description of specific embodiments of the invention, when read in conjunction with the accompanying drawings, wherein.

DETAILED DESCRIPTION OF EMBODIMENTS OF THE INVENTION

In the disclosure that follows, in the interest of clarity, not all features of actual implementations are described. It will of course be appreciated that in the development of any such actual implementation, as in any such project, numerous engineering and design decisions must be made to achieve the developers specific goals and subgoals (e.g., compliance with mechanical- and business-related constraints), which will vary from one implementation to another. Moreover, attention will necessarily be paid to proper engineering and design practices for the environment in question. It will be appreciated that such a development effort might be complex and time-consuming, but would nevertheless be a routine undertaking for those of skill in the art.

Figure 1A:
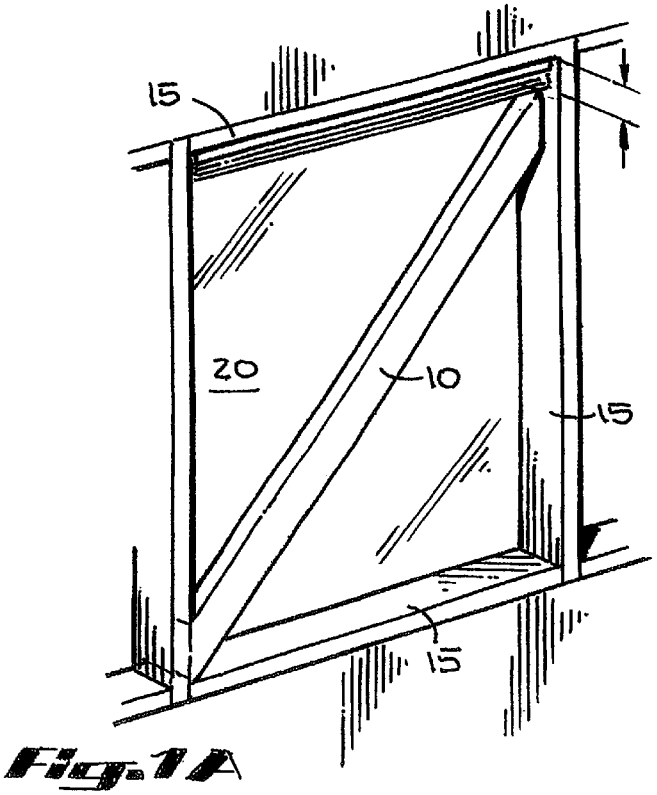
FIG. 1A shows a brace installed in a window frame from an angled perspective.
Figure 2:
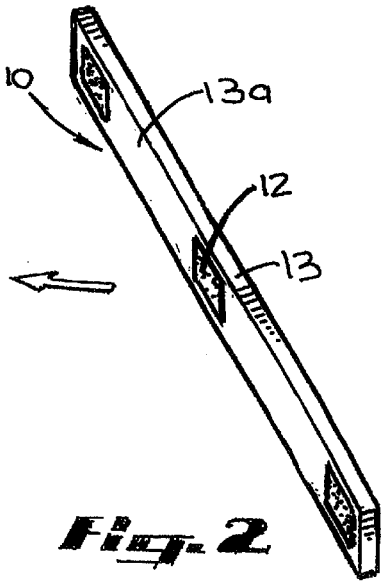
FIG. 2 shows the backside of the disclosed brace, including the adhesive layer affixed thereto.
Figure 1B:
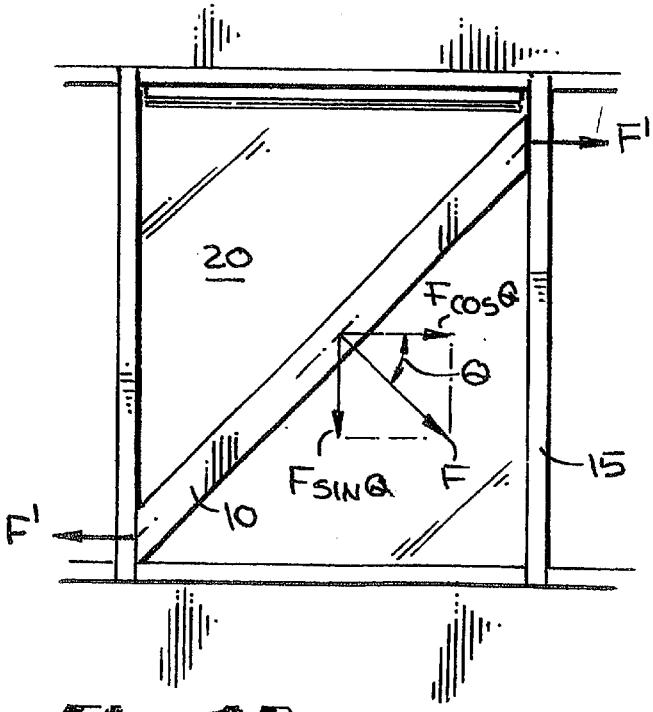
FIG. 1B shows the brace of FIG. 1A from a plan perspective.

FIGS. 1A and 1B show two different views of a first embodiment of a window brace 10 protecting a window 20 inside a window frame 16. In this embodiment, the brace 10 is preferably constructed to fit somewhere in the vicinity of one of the diagonals of window frame 15, although the brace need not strictly appear at the window diagonal as will be explained later. FIG. 2 shows brace 10 in more detail. Brace 10 includes a rigid member 13 which has affixed to it on one side 13*a* double-sided tape 12. Double-sided tape 12 may run for the entire length of brace 10, or may appear in small patches along the length. Preferably, the double-sided tape will appear in three pieces, each piece being approximately four inches long, along side 13*a*, as shown in FIG. 2. The double-sided tape 12, before being affixed to side 13*a* of rigid member 13 is generally protected on both sides by tape backing. Of course, at least one side of this tape backing must be removed to affix the double-sides tape 12 to side 13*a*, although it is not necessary to remove the tape backing on the side of tape 12 that faces away from side 13*a* until it is necessary to install the brace 10 in a window. While many types of double-sided tape 12 are suitable for use with brace 10, a clear double sided tape manufactured by 3M, Inc., Part No. 4658F ("Double Coated Removable Foam Tape"), is presently preferred because this tape exhibits suitable strength to adhere brace 10 to window 20, as it exhibits 15 pounds per square inch peel force per square inch; however, this tape can be easily removed without having to scrap the tape off of the window. Double-sided tape with a foam center of the kind readily found in hardware stores across the country will also function suitably well, but it generally is more difficult to remove from window 20. Alternatively, other forms of fast acting adhesive may be suitable to affix rigid member 13 to window 20, such as epoxies or glues.

Rigid member 13 of brace 10 can likewise be made from several different materials, although a suitably rigid material is preferable. Specifically preferable is the use of a hollow aluminum tube, which, may be the very same material that is used to manufacture window frames in modern business buildings (called "mullions"), but this is not strictly necessary. Wood, such as a two-by-two, or hard plastic may also work suitably as brace 10 for a given application. It is preferred that side 13*a* of rigid member 13 be flat so that double-sided tape 12 (or other suitable adhesive layer) can meet window 20 in a flat plane. This beneficial result is naturally achieved if the rigid member 13 is rectangular in cross-section, as it is in the disclosed figures.

To affix brace 10 within a window frame 15 and to window 20, a user would first remove the tape backing from the double-sided tape 12. Then the user would slide brace 10 within window frame 15 and bring the double-sided tape 12 firmly into contact with window 20. Placement of brace 10 within window 20 is easy and quick. In fact, a home or business that had a number of braces 10 on hand could easily position the braces on windows at a rate of only seconds per window, a factor which could be significant when faced with an impending storm.

In operation, brace 10 functions to protect window 20 during a high wind storm. Because brace 10 is affixed to window 20 by double-sided tape 12, the rigidity of brace 10 will keep window 20 from flexing substantially, at least in the vicinity of brace 10. By preventing at least some degree of window flexure, window 20 will be substantially protected from wind forces. This includes wind forces directed at the window (positive forces), and wind forces directed away from the window (negative forces), which can occur if window 20 is positioned relative to a storm such that a vacuum forms outside of the window. After a storm, it is usually preferred to remove braces 10 from the windows 20 they have protected.

As just explained, the disclosed brace can help prevent window breakage by the mere fact that the brace will prevent the window from flexing substantially. However, in this method of using the brace, the brace is essentially floating free. When employed in this manner, the brace will not provide as much protection to the window as if the brace were firmly held in place, and therefore may not be suitable for all applications. Moreover, it will not act to protect the structural integrity of the building. For applications in which window protection should be maximized and for applications in which it is desirable to protect the structural integrity of the building, it would be beneficial if brace 10 could be held stable with respect to window frame 15. Several embodiments are now disclosed which achieve this desirable effect.

The second embodiment involves the use of the brace as previously disclosed, but installed in a manner so as to wedge the brace within the window frame. This is accomplished by having the installer place a force on the brace prior to affixing it to the window. This force is illustrated in FIG. 1B at element F. Force F is preferably imparted by the installer's hands by pulling down on the brace 10 prior to affixing it to the window. As shown in FIG. 1B, and employing principles of trigonometry, Force F is transformed in relevant part into a horizontal component $F\cos(\theta)$. This horizontal force component exerts a force against the vertical edges of window frame 15, shown as Force F'. In other words, brace 10 is put under a compressive force, and becomes "pinned" between the vertical edges of window frame 15. When the brace 10 is thereafter affixed to window 20 by tape 12, this compressive force on brace 10 is locked into place (to the extent that the force is not relieved by any shearing stress occurring in the double-sided tape 12 or other adhesive layer), and also places the window 20 under some degree of compressive stress as well.

This compressive stress results in three effects which are conducive to protecting the window and the building. First, as already noted, brace 10 is held stable with respect to window frame 15. This substantially protects the window because any wind forces imparted to the window can be transferred through the glass to the window frame 15, and ultimately to the floor diaphragm and building foundation, which should be much better able to withstand this stress. Second, because the span of the window is effectively cut almost in half, the window will be more rigid and more able to withstand wind forces and impact from flying debris. Third, because brace 10 and window frame 15 are in firm contact, the combination of them acts as a sort of external building foundation which can absorb some of the wind shear stress, and thus help to protect the building itself from structural damage.

Modifications and improvements upon the disclosed embodiments should be readily apparent to those of skill in the art having the benefit of this disclosure. For example, one skilled in the art will recognize that many other shapes of brace 10 are possible which will work well as the brace disclosed in FIGS. 1A, 1B and 2. Also, the brace need not appear at the window's diagonal to perform adequately, although substantially spanning the diagonal is expected to produce the best results. In fact, as shown in the disclosed figures, the braces do not fit exactly along the windows diagonal so as to allow some clearance for the horizontal blinds that are affixed to the top of the window frame, Furthermore, other suitable means for mechanically affixing the brace to the window frame are well known to those skilled in the art. However, the use of mechanical bracing, while perhaps beneficial or even necessary in a given application, adds complexity, time, and cost to the window bracing process.

Figure 3A:
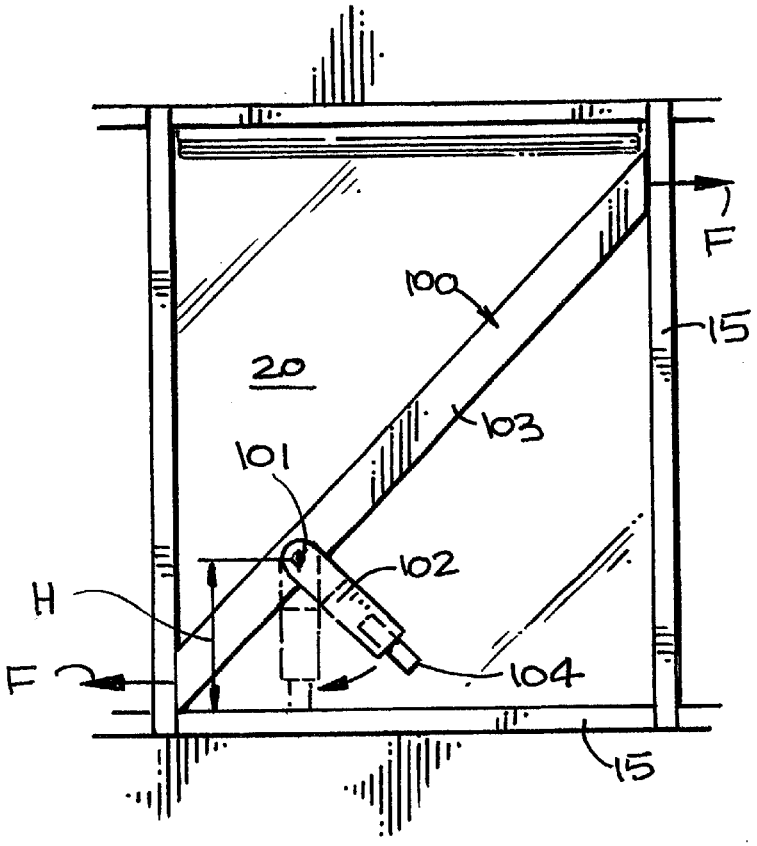
FIG. 3A shows an alternative embodiment of the brace including the use of a hinged member.

A third embodiment of a window brace 100 suitable for protecting both a window and the structural integrity of the building itself is shown in FIG. 3A. In this embodiment, brace 100 includes a rigid member 103 and a hinged member 102, which is hinged at bolt 101 to the rigid member 103. Hinged member 102, like rigid member 103, can be made of a suitably rigid material such as aluminum or wood. Hinged member 102 also has affixed to its end a wedge member 104 which is designed to be wedged against the bottom of window frame 15 when hinged member 102 is rotated to substantially a vertical position. Alternatively, hinged member 102 may be replaced entirely by wedge member 104 which may be directly bolted to rigid member 103 if wedge member 104 is made of a suitably resilient material. Rigid member 103 also contains double sided tape on the side facing the window as in the first and second embodiments, although this tape is not shown in the Figures.

Figure 3B:
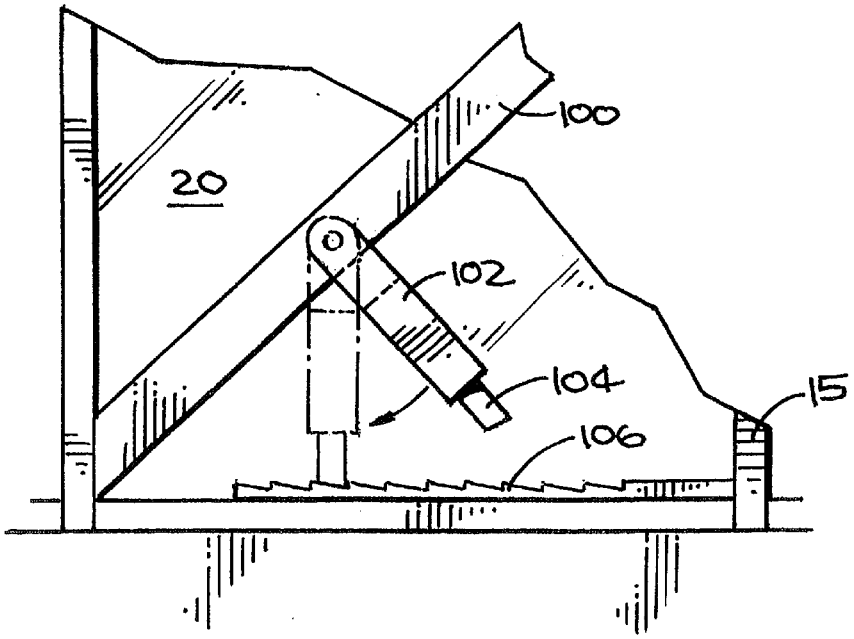
FIG. 3B shows a notched member suitable for use with the embodiment of FIG. 3A.

When installing brace 100, brace 100 is first placed in the window frame of the window to be protected. Then, hinged member 102 is rotated into a substantially vertical position as shown in FIG. 3A so that wedge member 104 is brought snuggly into contact with the bottom of window frame 15. it is important to note that hinged member 102 including wedge member 104 should be suitably sized so that it achieves the proper height H when swung into position as shown in FIG. 3A. Wedge member 104 should be of a suitably rigid material such as wood or hard rubber such that it can be firmly wedged against window frame 15 by the application of the installer's hand. This action of wedging wedge member 104 against the window frame acts to import a force F to the rigid member 103 which is met by the vertical edges of window frame 15, as in the second embodiment. Thus, the rotation of hinged member 102 essentially performs the same function as the installer imparting a force to the brace during installation. This acts to pin brace 100 within window frame 15, and, in conjunction with the double sided tape, provides superior rigidity to the window being braced and protection to the building. FIG. 3B shows a modification to the third embodiment in which a notched member 106 is positioned on the bottom edge of window frame 15 to receive the hinged member 102 when it is swung into position and to keep the hinged member 102 from slipping out of place.

Figure 4A:
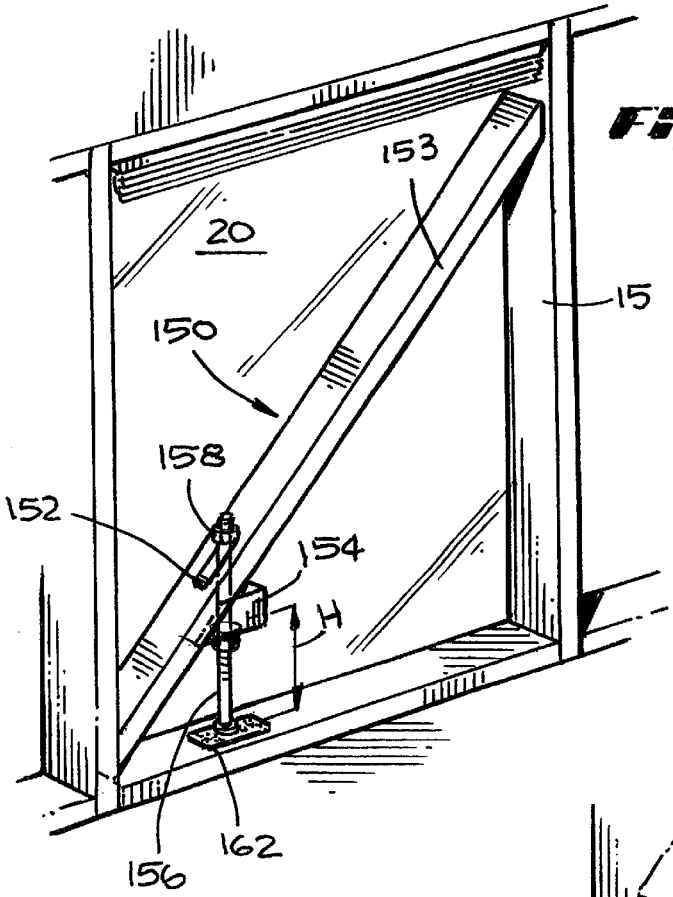
FIG. 4A shows another embodiment of the brace including the use of a swing arm.
Figure 4B:
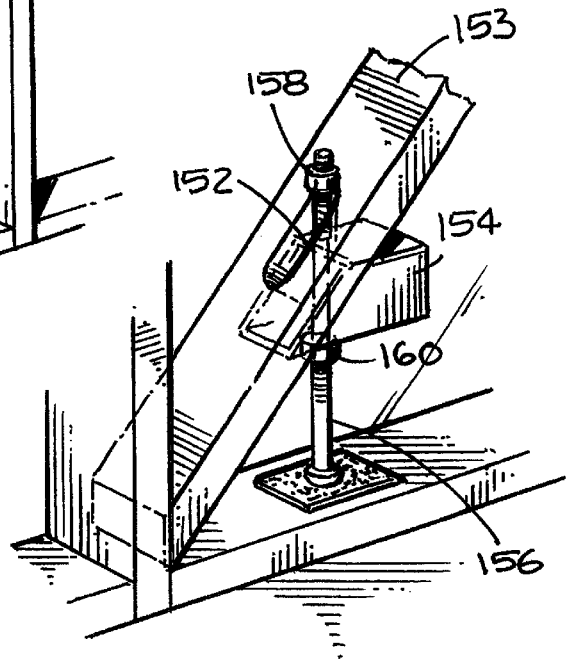
FIG. 4B shows a magnified view of a portion of the embodiment of FIG. 4A.
Figure 4C:
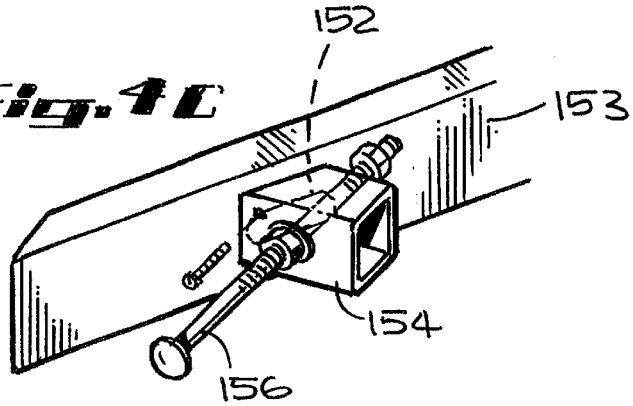
FIG. 4C shows the underside of the embodiment of FIG. 4A.

A fourth embodiment of a window brace 150 suitable for protecting both a window and the structural integrity of the building itself is shown in FIGS. 4A, 4B and 4C. In this embodiment the rigid member 153 includes a slot 152, and a bracket 154 through which is placed an adjustable swing arm 156. Because swing arm 156 is of a smaller diameter than slot 152, swing arm 156 will swing freely with respect to rigid member 153. As in the other embodiments, rigid member 153 is formed of a suitably rigid material such as aluminum or wood. Swing arm 156 can constitute any number of structures, but preferably constitutes a large bolt. Bolt 156 has affixed to it two nuts 158 and 160. Nut 158 simply prevents bolt 156 from falling out of the structure. Nut 160 allows the height H of bolt 156 to be adjusted for a given window shape. Rigid member 153 also contains double sided tape on the side facing the window as in the other embodiments, although this tape is not shown in the Figures.

When installing brace 150, brace 150 is first placed in the window frame of the window to be protected. Then, swing arm 156 is rotated into a substantially vertical position as shown in FIG. 4A so that swing arm 156 is brought snuggly into contact with the bottom of window frame 15. It may be necessary to adjust nut 160 to adjust the height H of swing arm 156 so that it will be substantially vertical when wedged into position. In order to protect the window frame 15 from damage, a small piece of felt or foam padding 162 can be placed underneath the swing arm 156. This action of wedging the swing arm 156 against the window frame acts to import a force to rigid member 153 which is met by the vertical edges of window frame 15, as in the other embodiments. This acts to pin brace 150 within the window frame, and, in conjunction with the double sided tape, provides superior rigidity to the window being braced.

Figure 5A:
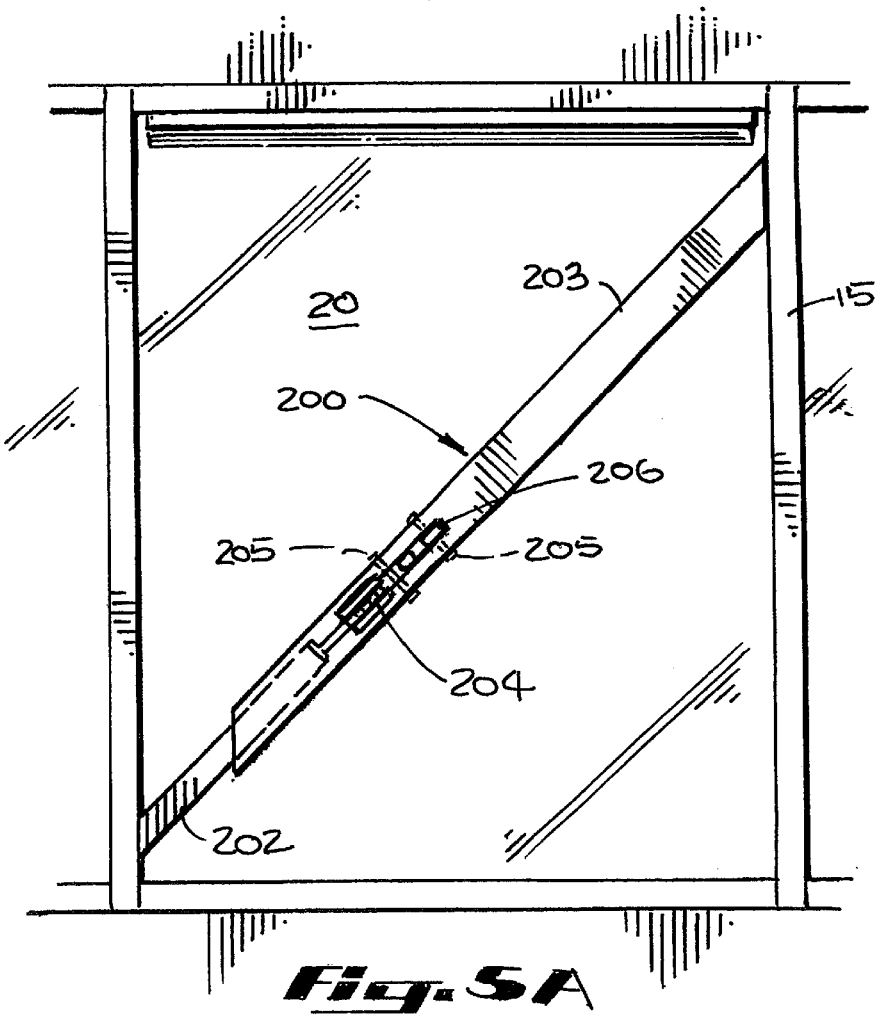
FIG. 5A shows another embodiment of the brace including the use of a ratchet and piston.
Figure 5B:
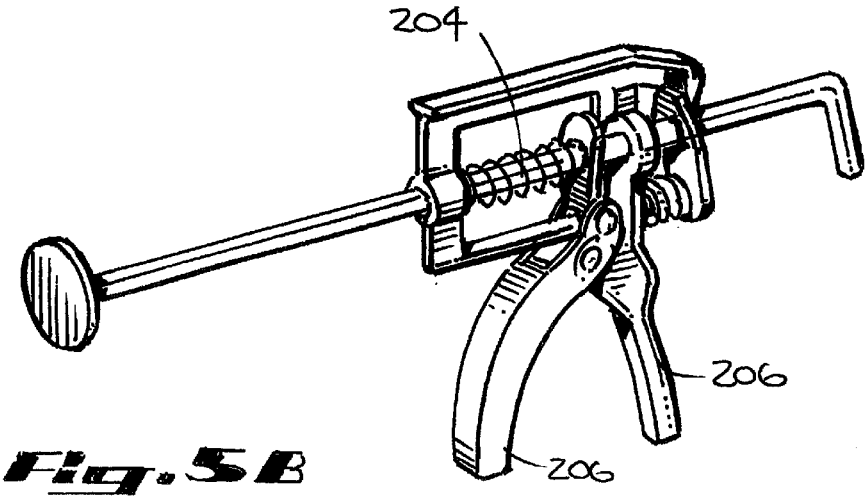
FIG. 5B shows the ratchet (e.g., a caulking gun) of the embodiment of FIG. 5A.

A fifth embodiment of a window brace 200, presently preferred by the inventor, is shown in FIGS. 5A and 5B. In this embodiment, rigid member 203 is preferably hollow and has contained within it a ratchet 204 and a piston 202. In this embodiment, rigid member 203 is preferably a 2 inch by 2 inch ⅜ inch gauge aluminum tube that when installed at the window's diagonal will cut the span of the window in half. Piston 202 is designed to advance outward slightly from rigid member 203 when the installer engages ratchet member 204 at ratchet handles 206. This happens as follows: when the installer presses ratchet handles 206, ratchet member 204 advances by a set amount. Because ratchet member 204 is affixed to piston 202, piston 202 will be advanced outside of the rigid member 203. While one skilled in the art will realize that several ratcheting mechanisms could provide the action needed to advance the piston member 202, it has been found that a standard caulking gun works well as ratchet 204. A standard caulking gun usable as ratchet 204 is shown in FIG. 5B. The caulking gun or other ratchet can be incorporated into the rigid member but cutting the necessary holes in the side of the rigid member 202, inserting the caulking gun, and securing the gun in place, for example, by pins 205. Other advancing mechanisms could possibly take the place of ratchet 204, including screw type mechanisms. As in the other embodiments, brace 200 contains double sided tape. Also, as in the second embodiment, piston 202 should be of a suitably rigid material such as wood or hard rubber such that it can be firmly wedged against window frame 15 by engaging ratchet handles 206. While it is presently preferred that piston 202 and ratchet 204 are placed within a hollow rigid member 202, one skilled in the art will recognize that the piston and ratchet could be placed on the outside of a hollow or solid rigid member and affixed thereto by suitable mechanical means to achieve the same effect as in the disclosed embodiment.

When installing brace 200, brace 200 is first placed in the window frame of the window to be protected. Thereafter, the installer engages ratchet member 204 at ratchet handles 206 to advance piston 202 until it is brought into firm contact with window frame 15. Using this embodiment, it is estimated that approximately 100 pounds of force can be imparted to window frame 15, thereby creating in effect a vertical truss. With this installation accomplished, the fifth embodiment, like the second, third and fourth embodiments, provides a strong force against the window frame, and, in conjunction with the double sided tape, provides superior rigidity to the window being braced. In effect, this composite system greatly increases the resistance of window 20 to hurricane force winds, and also absorbs some of the wind force that would otherwise be absorbed by window frame 15. This protects both the structural integrity of the building and protects window 20 from positive and negative wind pressures and flying debris. Brace 200, double sided tape 12, window 20, and window frame 15 act together as one unit to form a vertical truss.

Figure 6B:
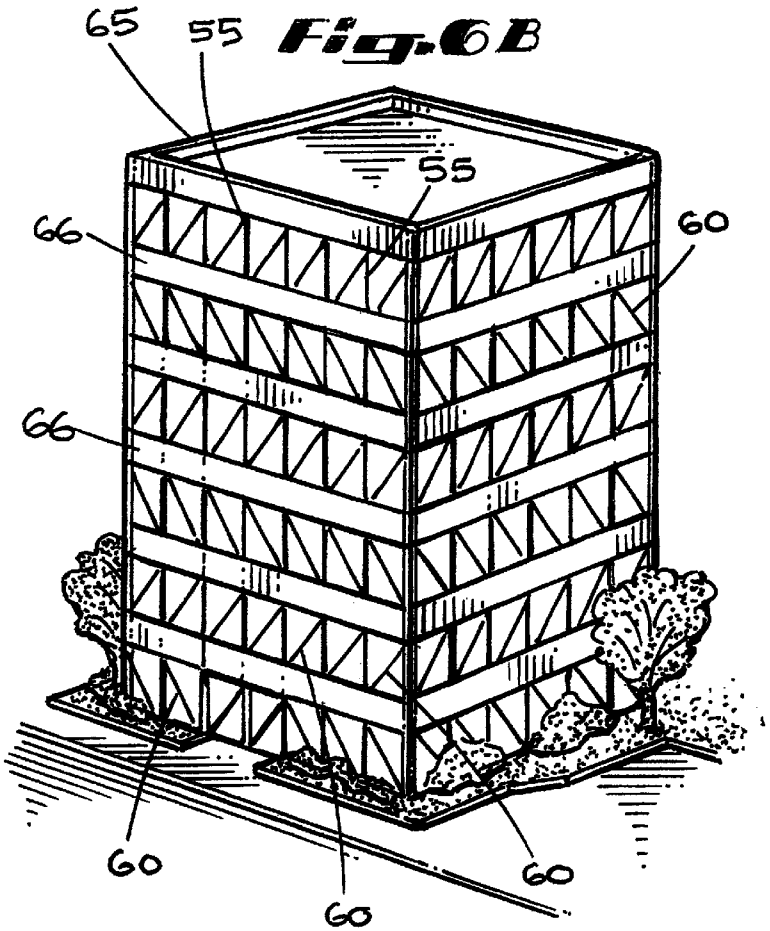
FIG. 6B shows the outside of the building of FIG. 6A.
Figure 6A:
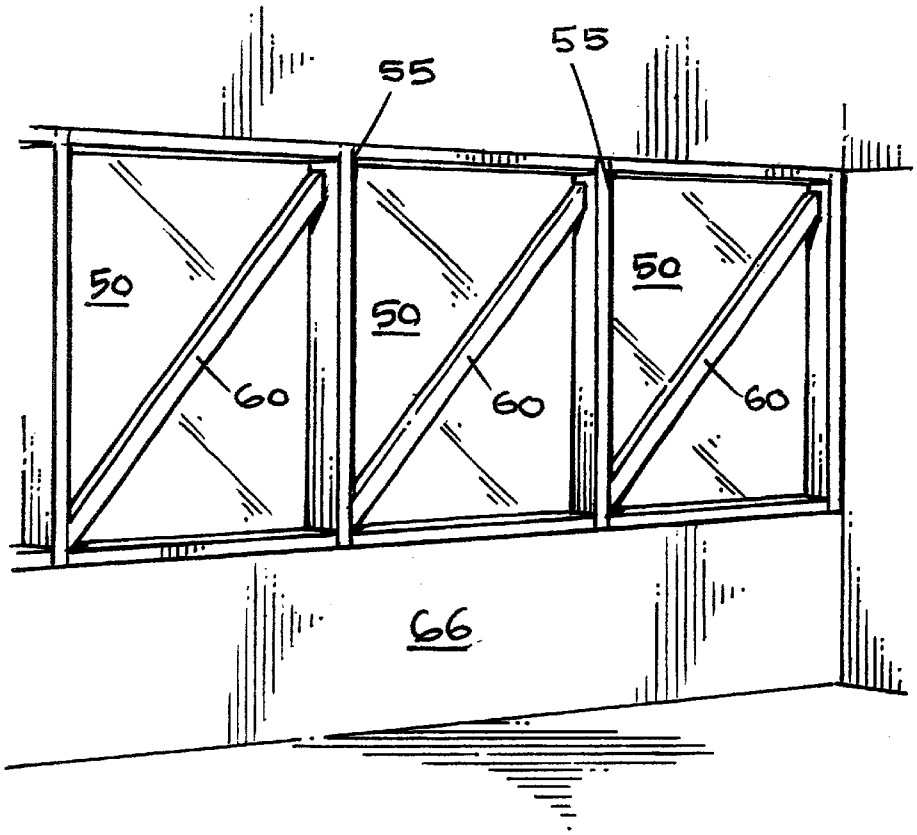
FIG. 6A shows several braces installed in an office in a building.

As previously noted, another advantage provided by the disclosed embodiments of a window brace is the ability to strengthen the building into which it is placed. Referring to FIG. 6A, a typical expanse of windows 50 from inside a typical office in a typical office building is shown. Separating each of windows 50 are mullions 55, which essentially perform the same function as window frame 15 in the earlier Figures. Mullions 55 are typically hollow anodized aluminum and are approximately 1.25 by 4 inches in cross section. The windows 50 are typically approximately 5 feet wide by 6 or 7 feet high. As mentioned earlier, the mullions 55 and windows 60 are designed and positioned to withstand some degree of wind loading, but are also usually positioned to provide suitable building aesthetics. In some office buildings, the windows are taller, stretching all the way from the floor to the ceiling, in which case the mullions are supported directly by the floor structures.

Installed in each of the windows 50 are braces 60, which could be any of the second, third, fourth or fifth embodiments disclosed herein. When braces 60 are placed in each of the windows in a given office building 65, building 65 will appear as shown in FIG. 6B. (Braces 60 are typically not seen at locations 66 because these locations comprise a wall portion (see FIG. 6A) and the spaces between floors in the building). The outside surface of the building may incorporate other building materials such as brick stone or glass spandrel, which would usually appear at locations 66. When building 65 has braces 60 installed as shown, the cumulative effect of all of the braces 60 is to add additional external structural support to the internal structural support of building 65. Specifically, braces 60 will help the original building components and will cut down on the torsion effect and sway of the building during the very critical time periods when such extra protection is needed.

Of course, it may not be practical to install braces 60 in every window 50 of a given building 65. However, even if some of the windows do not contain a brace 60, it should be noted that even the installation of a single brace 60 will provide a benefit to the structural integrity of the building 65, although the contribution of a single brace may be inconsequential. Generally, the benefit to the structural integrity of the building 65 will be a function of how many braces 60 are installed therein. Of course, it would be ideal to install braces 60 in every window of a given building, as shown in FIG. 6B, because this would maximize window protection and also creates an external building support structure which will reinforce the entire building from torsion, shear, severe deflection, and other effects caused by high wind forces. Furthermore, while it is expected that the disclosed braces of the third, fourth, and fifth embodiments will work to protect the building best when they are adhered to windows by the adhesive layer, one skilled in the art will recognize that structural benefit to the building exists even if the braces are not so adhered.

All of the disclosed braces are highly advantageous in that, once they are on hand and in response to an impending hurricane warning, they can be installed in a relatively short time period by either a building's tenants or its management well in advance of the approach of the storm. Moreover, the disclosed braces are easy to remove and should be capable of reuse many times over a period of many years. However, between uses it may be necessary to peel double sided tape 12 from the brace and replace it with new tape. The disclosed braces are also relatively cheap to manufacture, making them a very cost-effective solution for hurricane protection.

From the foregoing detailed description of specific embodiments of the invention, it should be apparent that a device and method for protecting windows and buildings during high wind storms has been disclosed. Although specific embodiments of the invention have been disclosed herein in some detail, this has been done solely for the purposes of illustrating various aspects and features of the invention, and is not intended to be limiting with respect to the scope of the invention. It is contemplated that various substitutions, alterations, and/or modifications, including but not limited to those design alternatives which might have been specifically noted in this disclosure, may be made to the disclosed embodiment without departing from the spirit and scope of the invention as defined in the appended claims.

What is claimed is:

1. A brace for protecting a window during a high wind storm, comprising:

a rigid member sized so as to fit within a window frame containing the window to be protected;

an adhesive layer affixed to one side of the rigid member for affixing the rigid member to the window to be protected; and a means for imparting a force between the rigid member and the window frame.

2. The brace of claim 1, wherein the rigid member is hollow.

3. The brace of claim 1, wherein the adhesive layer is affixed in three places along the length of the rigid member.

4. The brace of claim 1, wherein the adhesive layer is double-sided tape.

5. The brace of claim 1, further comprising a hinged member affixed to the rigid member, the hinged member being rotatable with respect to the rigid member such that a portion of the hinged member abuts the window frame to impart the force between the rigid member and the window frame.

6. The brace of claim 1, further comprising a swing arm affixed to the rigid member, the swing arm being rotatable with respect to the rigid member such that a portion of the swing arm abuts the window frame to impart the force between the rigid member and the window frame.

7. The brace of claim 1, further comprising a ratchet connected to the rigid member for advancing a piston out from the rigid member such that a portion of the piston abuts the window frame to impart the force between the rigid member and the window frame.

8. The brace of claim 7, wherein the ratchet is a caulking gun.

9. The brace of claim 7, wherein the piston and ratchet are included within the rigid member.

10. A method for protecting a window in a window frame during a high wind storm, comprising, in no particular order:

placing a rigid member having an adhesive layer affixed to a side thereof within a window frame;

affixing the rigid member to the window with the adhesive layer; and imparting a force on the rigid member to wedge the rigid member within the window frame.

11. The method of claim 10, wherein the rigid member is placed along a diagonal of the window.

12. The method of claim 10, wherein the force includes pulling the rigid member.

13. The method of claim 10, wherein the adhesive layer is affixed in three places along the length of the rigid member.

14. The method of claim 10, further comprising the step of mechanically affixing the brace to the window frame.

15. The method of claim 10, wherein the adhesive layer is double-sided tape.

16. The method of claim 10, wherein the rigid member includes a hinged member rotatably affixed to the rigid member, and further comprising the step of, in no particular order, rotating the hinged with respect to the rigid member such that a portion of the hinged member abuts the window frame to impart a force between the rigid member and the window frame.

17. The method of claim 10, wherein the rigid member includes a hinged member rotatably affixed to the rigid member, and further comprising the step of, in no particular order, rotating the hinged member with respect to the rigid member such that a portion of the hinged member is brought into contact with a notched member integral to the window frame.

18. The method of claim 10, wherein the rigid member includes a swing arm affixed thereto, and further comprising the step of, in no particular order, rotating the swing arm with respect to the rigid member such that a portion of the swing arm abuts the window frame to impart a force between the rigid member and the window frame.

19. The method of claim 10, wherein the rigid member includes a ratchet in contact with the rigid member, and further comprising the step of, in no particular order, engaging the ratchet to advance a piston out from the rigid member such that a portion of the piston abuts the window frame to impart a force between the rigid member and the window frame.

20. The method of claim 19, wherein the ratchet is a caulking gun.

21. The method of claim 19, wherein the piston and ratchet are included within the rigid member.

22. A brace for protecting a building during a high wind storm, the building having a plurality of windows with window frames, comprising:

a rigid member sized so as to fit within a window frame containing a window in the building to be protected; and a hinged member affixed to the rigid member, the hinged member being rotatable with respect to the rigid member such that a portion of the hinged member abuts the window frame to impart a force between the rigid member and the window frame.

23. The brace of claim 22, further comprising an adhesive layer affixed to one side of the rigid member, the adhesive layer for affixing the rigid member to the window.

24. The brace of claim 23, wherein the adhesive layer is double-sided tape.

25. The brace of claim 23, wherein the adhesive layer is affixed in three places along the length of the rigid member.

26. A brace for protecting a building during a high wind storm, the building having a plurality of windows with window frames, comprising:

a rigid member sized so as to fit within a window frame containing a window in the building to be protected; and a swing arm affixed to the rigid member, the swing arm being rotatable with respect to the rigid member such that a portion of the swing arm abuts the window frame to impart a force between the rigid member and the window frame.

27. The brace of claim 26, further comprising an adhesive layer affixed to one side of the rigid member, the adhesive layer for affixing the rigid member to the window.

28. The brace of claim 27, wherein the adhesive layer is double-sided tape.

29. The brace of claim 27, wherein the adhesive layer is affixed in three places along the length of the rigid member.

30. A brace for protecting a building during a high wind storm, the building having a plurality of windows with window frames, comprising:

a rigid member sized so as to fit within a window frame containing a window in the building to be protected; and a ratchet connected to the rigid member for advancing a piston out from the rigid member such that a portion of the piston abuts the window frame to impart a force between the rigid member and the window frame.

31. The brace of claim 30, wherein the rigid member is hollow.

32. The brace of claim 30, further comprising an adhesive layer affixed to one side of the rigid member, the adhesive layer for affixing the rigid member to the window.

33. The brace of claim 30, wherein the adhesive layer is affixed in three places along the length of the rigid member.

34. The brace of claim 30, wherein the adhesive layer is double-sided tape.

35. The brace of claim 30, wherein the ratchet is a caulking gun.

36. The brace of claim 30, wherein the piston and ratchet are included within the rigid member.

37. A method for protecting a building during a high wind storm, the building having a plurality of windows with window frames, comprising the steps of, in no particular order:

placing a rigid member having an adhesive layer affixed to a side thereof within a window frame;

affixing the rigid member to the window with the adhesive layer; and imparting a force on the rigid member to wedge the rigid member within the window frame.

38. The method of claim 37, wherein the rigid member is affixed to the window along a diagonal of the window.

39. The method of claim 37, wherein the force is formed by the pulling the rigid member.

40. The method of claim 37, wherein the adhesive layer is affixed in three places along the length of the rigid member.

41. The method of claim 37, further comprising the step of mechanically affixing the brace to the window frame.

42. The method of claim 37, wherein the adhesive layer is double-sided tape.

43. The method of claim 37, wherein the rigid member includes a hinged member rotatably affixed to the rigid member, and further comprising the step of rotating the hinged with respect to the rigid member such that a portion of the hinged member abuts the window frame to impart the force between the rigid member and the window frame.

44. The method of claim 37, wherein the rigid member includes a hinged member rotatably affixed to the rigid member, and further comprising the step of rotating the hinged member with respect to the rigid member such that a portion of the hinged member is brought into contact with a notched member in contact with the window frame.

45. The method of claim 37, wherein the rigid member includes a swing arm affixed thereto, and further comprising the step of rotating the swing arm with respect to the rigid member such that a portion of the swing arm abuts the window frame to impart the force between the rigid member and the window frame.

46. The method of claim 37, wherein the rigid member includes a ratchet in contact with the rigid member, and further comprising the step of engaging the ratchet to advance a piston out from the rigid member such that a portion of the piston abuts the window frame to impart a force between the rigid member and the window frame.

47. The method of claim 46, wherein the ratchet is a caulking gun.

48. The method of claim 46, wherein the piston and ratchet are included within the rigid member.

49. A brace for protecting a window during a high wind storm, comprising:

a rigid member sized so as to fit within a window frame containing the window to be protected;

an adhesive layer affixed to one side of the rigid member for affixing the rigid member to the window to be protected; and a hinged member affixed to the rigid member, the hinged member being rotatable with respect to the rigid member such that a portion of the hinged member abuts the window frame to impart a force between the rigid member and the window frame.

50. The brace of claim 49, wherein the rigid member is hollow.

51. The brace of claim 49, wherein the adhesive layer is affixed in three places along the length of the rigid member.

52. The brace of claim 49, wherein the adhesive layer is double-sided tape.

53. A brace for protecting a window during a high wind storm, comprising:

a rigid member sized so as to fit within a window frame containing the window to be protected;

an adhesive layer affixed to one side of the rigid member for affixing the rigid member to the window to be protected; and a swing arm affixed to the rigid member, the swing arm being rotatable with respect to the rigid member such that a portion of the swing arm abuts the window frame to impart a force between the rigid member and the window frame.

54. The brace of claim 53, wherein the rigid member is hollow.

55. The brace of claim 53, wherein the adhesive layer is affixed in three places along the length of the rigid member.

56. The brace of claim 53, wherein the adhesive layer is double-sided tape.

57. A brace for protecting a window during a high wind storm, comprising:

a rigid member sized so as to fit within a window frame containing the window to be protected;

an adhesive layer affixed to one side of the rigid member for affixing the rigid member to the window to be protected; and a ratchet connected to the rigid member for advancing a piston out from the rigid member such that a portion of the piston abuts the window frame to impart a force between the rigid member and the window frame.

58. The brace of claim 57, wherein the rigid member is hollow.

59. The brace of claim 57, wherein the adhesive layer is affixed in three places along the length of the rigid member.

60. The brace of claim 57, wherein the adhesive layer is double-sided tape.

61. The brace of claim 57, wherein the ratchet is a caulking gun.

62. The brace of claim 57, wherein the piston and ratchet are included within the rigid member.

* * * * *

UNITED STATES PATENT AND TRADEMARK OFFICE

CERTIFICATE OF CORRECTION

PATENT NO. : 6,408,592 B1
DATED : June 25, 2002
INVENTOR(S) : Monzer A. Hourani

It is certified that error appears in the above-identified patent and that said Letters Patent is hereby corrected as shown below:

Title page,
Item [22], filing date is changed from "Sep. 18, 2000" to -- Sep. 19, 2000 --.

Signed and Sealed this

Seventeenth Day of September, 2002

*Attest:*

*Attesting Officer*

JAMES E. ROGAN
*Director of the United States Patent and Trademark Office*